United States Patent [19]

Chang

[11] 4,339,519

[45] Jul. 13, 1982

[54] HUMIDITY RESISTANT PHOTOCONDUCTIVE PLATE CONTAINING TREATED CDSSE

[75] Inventor: Mike S. H. Chang, Danbury, Conn.

[73] Assignee: Pitney Bowes, Inc., Stamford, Conn.

[21] Appl. No.: 214,054

[22] Filed: Dec. 8, 1980

[51] Int. Cl.[3] ..... G03G 7/00

[52] U.S. Cl. ..... 430/135; 430/136; 430/89; 430/94; 427/221; 427/220; 428/405; 428/407

[58] Field of Search ..... 430/136, 89, 94, 135; 427/221, 220; 428/405, 407

[56] References Cited

U.S. PATENT DOCUMENTS 4,020,192 4/1977 Nozaki ..... 430/108

4,125,667 11/1978 Jones ..... 430/111

*Primary Examiner*—John D. Welsh

*Attorney, Agent, or Firm*—Melvin J. Scolnick; William D. Soltow, Jr.; Albert W. Scribner

[57] ABSTRACT

Improvement in the humidity resistance of photoconductive cadmium sulfoselenide (CdSSe) is achieved by soaking commercially available CdSSe in a solution of vinylidene chloride-acrylonitrile copolymer in an organic solvent, followed by removing the excessive solution and then heating the soaked photoconductive material.

14 Claims, No Drawings

HUMIDITY RESISTANT PHOTOCONDUCTIVE PLATE CONTAINING TREATED CDSSE

BACKGROUND OF THE DISCLOSURE

I. Field of the Invention

This invention relates to treating photoconductive compositions, and more particularly, to a method for improving the humidity resistance of photoconductive cadmium sulfoselenide (CdSSe).

II Description of the Prior Art

The forming and developing of images on the surface of certain photoconductive materials by electrostatic means is now well known. Carlson, in U.S. Pat. No. 2,297,691 teaches the basic xerographic process which involves uniformly charging a photoconductive insulating layer and then exposing the layer to a light-and-shadow image which dissipates the charge on the portions of the layer which are exposed to light. The electrostatic latent image formed on the layer corresponds to the configuration of the light-and-shadow image. In another modification, a latent electrostatic image is formed on the photoconductive insulating layer by charging the layer in image configuration. A finely divided developing material comprising a colorant called a toner and a toner carrier is deposited on the image layer. The developing material is normally attracted to those portions of the layer which retain a charge, thereby forming a powder image corresponding to the latent electrostatic image. The powder image may then be transferred to paper or any other receiving surface. The powder image is permanently bonded to the paper by any suitable fixing means. Typically, a heating process called fusing is used. For example, see the fusing processes described in U.S. Pat. Nos. 2,357,809, 2,891,011 and 3,079,342.

It is possible to employ a wide variety of photoconductive insulating materials in the electrostatic process. For example, Carlson, in U.S. Pat. No. 2,297,691 discloses photoconductive insulating materials such as anthracene, sulfur, selenium or mixtures thereof.

These photoconductive materials generally have sensitivity in the blue or near ultraviolet range, and all but selenium have a further limitation of being only slightly light sensitive. For this reason, selenium has been the most commercially accepted material for use in electrophotographic plates. Vitreous selenium, however, while desirable in most aspects, suffers from serious limitations in that its spectral response is somewhat limited to the ultraviolet, blue and green region of the spectrum, and the preparation of vitreous selenium plates requires costly and complex procedures, such as vacuum evaporation. Also, selenium plates require the use of a separate conductive substrate layer, preferably with an additional barrier layer deposited thereon before disposition of the selenium photoconductor. Because of these economic and commercial considerations, there have been many recent efforts towards developing photoconductive insulating materials other than selenium for use in electrophotographic plates.

It has been proposed that various two-component materials be used in photoconductive insulating layers used in electrophotographic plates. For example, the use of inorganic photoconductive pigment dispersed in suitable binder materials to form photoconductive insulating layers is known. It has further been demonstrated that organic photoconductive insulating dyes and a wide variety of polycyclic compounds may be used together with suitable resin materials to form photoconductive insulating layers useful in binder-type plates. In each of these two systems, it is necessary that at least one original component that is used to prepare the photoconductive insulating layer be, itself, a photoconductive insulating material.

There are a number of other photoconductive insulating materials in the prior art which have been used with varying degrees of success including pigments such as cadmium sulfide, cadmium selenide and cadmium sulfoselenide an disclosed in U.S. Pat. Nos. 3,121,006, 3,121,007, 3,151,982, 3,288,604 and 3,109,753. Cadmium sulfoselenide has also been used in conjunction with activator metals such as silver or copper and with or without co-activators, generally halides such as chlorine, bromine and iodine and/or combined with metal impurities or metal salts of zinc as disclosed in British Pat. No. 1,201,128, and with ZnO. The use of a mixed pigment photoconductor (ZnO mixed with CdSSe) can provide an increased light sensitivity over that exhibited by conventional ZnO photoconductors. Still further, compositions of various sulfides and selenides of cadmium and zinc have been used as photoconductors as disclosed, for example, in U.S. Pat. No. 3,121,006.

As an integral part of an electrographic process which employs any of the above referred to photoconductors, the photoconductive surface must exhibit certain electrical properties which, of course, depends upon the characteristics of the electrographic process. One thing that can often adversely affect these electrical properties is humidity. Generally speaking, it is at high levels of relative humidity that the quality of reproduction deteriorates, often to the point that little or no image delination is obtained. Since controlling humidity by external means is generally very expensive, it is considered desirable to have a photoconductive composition which itself has high humidity resistance. Some prior art examples where this problem has been considered are disclosed in U.S. Pat. Nos. 3,736,134, 3,850,632 and 3,912,511.

The ZnO-CdSSe mixed pigment photoconductors that have been formulated from different grades of cadmium sulfoselenide (CdSSe) exhibit varying degrees of humidity sensitivities. As a result of this, the reliability of the electrical properties of the ZnO-CdSSe photoconductors has suffered severely.

SUMMARY OF THE INVENTION

It is therefore a primary object of the present invention to provide for ZnO-CdSSe mixed pigment photoconductors which are highly resistant to humidity by providing a simple and relatively inexpensive method for increasing the humidity resistance of photoconductive cadmium sulfoselenide (CdSSe).

The foregoing object and others are accomplished in accordance with the present invention by providing a method for increasing the humidity resistance of photoconductive cadmium sulfoselenide comprising the steps of first soaking cadmium sulfoselenide particles in a solution of vinylidene chloride-acrylonetrile copolymer in an organic solvent, followed by removing the excessive solution and then heating the soaked cadmium sulfoselenide particles.

DESCRIPTION OF THE PREFERRED EMBODIMENTS

Broadly stated, the process of this invention involves a method for increasing the humidity resistance of photoconductive cadmium sulfoselenide (CdSSe) comprising the steps of first soaking cadmium sulfoselenide particles in a solution of vinylidene chloride-acrylonitrile copolymer in an organic solvent. Preferably, in accordance with the present invention this is done by soaking the CdSSe particles in an organic solvent such as an acetone solution containing from about 0.001% to about 5% by weight of vinylidene chloride-acrylonitrile copolymer for a time period ranging from about ten (10) minutes to about five (5) hours. However, in accordance with the present invention soaking in an acetone solution of from about 0.01% to about 0.5% by weight vinylidene chloride-acrylonitrile copolymer for a time period of about fifty (50) minutes to about ninety (90) minutes is most preferred. The excessive solvent is then removed. This is preferably done by a decanting process. Thereafter, the soaked particles are heated so as to place a thin film of the copolymer on the particles. This is preferably done in an oven where the particles are heated to a temperature ranging from about 100° F. to about 300° F. for a time period ranging from about thirty (30) minutes to about ten (10) hours, and most preferably, to a temperature ranging from about 150° F. to about 175° F. for a time period ranging from about two (2) hours to about three (3) hours.

The present invention will be described in detail with reference to the following examples for illustrative purposes.

EXAMPLE 1

This example illustrates the different effects that humidity has on CdSSe with regard to both samples treated in accordance with the present invention and untreated samples, after the samples are formulated into mixed pigment photoconductors of ZnO-CdSSe.

6.2 grams of CdSSe (Ferro Dark Red) was soaked overnight (about 8–10 hours) in 30 ml. of acetone solution containing 0.006 gm. of vinylidene chloride-acrylonitrile copolymer (Saran F310, Dow Chemical Company). After the acetone was stripped, the treated CdSSe was baked at 150° F. for 2.5 hours. Thereafter the CdSSe was formulated with 18 gm. of photoconductive ZnO (New Jersey Zinc Company, Photox 801, baked at 650° F. for one hour), using 4 gm. Amberlac 292T and 4 gm. Acryloid B-66 (Rohm & Haas Corporation) as a binder, and 20 gm. of toluene as a diluent. These mixed components were put in a 6 oz. jar with 25, ½" balls and milled for 30 minutes. The photoconductor prepared therefrom had a light sensitivity $t_{\frac{1}{2}}=0.09$ fcs ($t_{\frac{1}{2}}$ is the time required to discharge half of the charge acceptance shown on Victoreen, and fcs is foot-candle-sec) and still kept the same sensitivity after being placed in a chamber at 70% RH for 15 minutes. In the case of the photoconductor sample prepared from untreated CdSSe as a control the $t_{\frac{1}{2}}$ became 0.26 fcs after 15 minutes at 70% RH (RH is relative humidity).

EXAMPLE 2

This example is used to illustrate that the mixed pigment photoconductor (ZnO-CdSSe) prepared in accordance with the present invention shows an improved humidity sensitivity even at humidity levels of 90% RH. 620 gm. of CdSSe (Ferro Dark Red, lot 12-322-50) was soaked in a 0.1 Wt.% acetone solution of vinylidine chloride-acrylonitrile copolymer (Saran F310, Dow Chemical Corporation) overnight (approximately 8–10 hours) followed by decanting the acetone solution and then baking the treated CdSSe particles at 150° F. in an oven for 2.5 hours. The CdSSe particles were then ball-milled together with 1,800 gm. of photoconductive ZnO, 400 gm. of Amberlac 292T and 400 gm. of Acryloid B-66 with the addition of 1300 gm. of toluene until the fineness of the grind became about 1.3 ml. at Hegman gauge. The photoconductor, with aluminized Mylar as a substrate, showed no change in $t_{\frac{1}{2}}$ when kept at 0.08 fcs after it was kept for 7 days in a chamber at 90% RH. The $t_{\frac{1}{2}}$ of the control sample from untreated CdSSe became 0.22 fcs after 15 minutes at 70% RH.

I claim:

1. A method for increasing the humidity resistance of photoconductive cadmium sulfoselenide comprising the steps of:

(a) soaking cadmium sulfoselenide particles in a solution of vinylidene chloride-acrylonitrile copolymer in an organic solvent;

(b) removing any excessive solution; and (c) heating said soaked cadmium sulfoselenide particles.

2. A method according to claim 1 wherein said organic solvent is acetone.

3. A method according to claim 1 wherein said excessive solvent is removed by decanting.

4. A method according to claim 2 wherein said particles are soaked in said acetone solution for a time period ranging from about ten minutes to about five hours.

5. A method according to claim 2 wherein said acetone solution comprises from about 0.001% to 5% by weight of said vinylidene chloride-acrylonitride copolymer.

6. A method according to claim 2 wherein said acetone solution comprises from about 0.01% to about 0.05% by weight of said vinylidene chloride-acrylonitrile copolymer.

7. A method according to claim 2 wherein said soaked particles are heated to a temperature of about 100° F. to about 300° F.

8. A method according to claim 6 wherein said particles are heated for a period of time ranging from about 30 minutes to about 10 hours.

9. A method according to claim 2 wherein said soaked particles are heated to a temperature of about 150° F. to about 175° F.

10. A method according to claim 9 wherein said particles are heated for a period of time ranging from about 2 hours to about 3 hours.

11. A method according to claim 1 wherein said cadmium sulfoselenide is mixed with photoconductive zinc oxide particles after step (c).

12. A method for increasing the humidity resistance of photoconductive cadmium sulfoselenide comprising the steps of:

(a) soaking cadmium sulfoselenide particles in an acetone solution of 0.01% to about 0.5% by weight of vinylidene chloride-acrylonitrile copolymer;

(b) removing any excessive acetone solution; and (c) heating said soaked cadmium sulfoselenide particles at a temperature of about 150° F. to about 175° F. for a period of time ranging from about 2 hours to about 3 hours.

13. A method according to claim 12 wherein said particles are soaked in said acetone solution for a time period ranging from about 50 minutes to about 90 minutes.

14. A method according to claim 13 wherein said cadmium sulfoselenide is mixed with photoconductive zinc oxide particles after step (c).

* * * * *